United States Patent [19]

Ferrell

[11] Patent Number: 4,539,162

[45] Date of Patent: Sep. 3, 1985

[54] CHOKE ASSEMBLY FOR GOLF CART

[75] Inventor: James C. Ferrell, Martinez, Ga.

[73] Assignee: Club Car, Inc., Augusta, Ga.

[21] Appl. No.: 609,020

[22] Filed: May 10, 1984

[51] Int. Cl.[3] ..... F02M 1/02

[52] U.S. Cl. ..... 261/1; 261/64 E; 55/276

[58] Field of Search ..... 261/64 E, 1; 55/276

[56] References Cited

U.S. PATENT DOCUMENTS

| | | | |
|---|---|---|---|
| 1,018,447 | 2/1912 | Schenck | 261/64 E |
| 1,204,029 | 11/1916 | Johnson | 261/64 E |
| 1,556,179 | 10/1925 | Titman | 261/64 E |
| 2,781,032 | 2/1957 | Sebok et al. | 55/276 |
| 2,884,092 | 4/1959 | Reindl | 55/276 |
| 3,313,532 | 4/1967 | Carlson et al. | 261/DIG. 38 |
| 3,898,064 | 8/1975 | Tao et al. | 55/276 |
| 4,192,660 | 3/1980 | Ishidera et al. | 55/276 |

FOREIGN PATENT DOCUMENTS 363406 11/1922 Fed. Rep. of Germany .... 261/64 E

*Primary Examiner*—Tim Miles

*Attorney, Agent, or Firm*—Laurence R. Brown

[57] ABSTRACT

An air intake assembly for a golf cart engine provides an air inlet port in a passenger compartment shielded from road dust for introducing clean air for combustion into the carburetor located in the rear mount engine compartment, as connected by flexible air flow tubing. A special choke mechanism located in the passenger compartment eliminates the need for a butterfly valve in the carburetor and the need for a choke cable extending between the two compartments. Thus, choking is achieved by manually operating a biased open valve in the form of a cover cap on the air inlet port to restrict air inlet flow at a convenient location in the passenger compartment, rather than by a complex and critical butterfly assembly in the carburetor connected by a cable to a driver accessible location. The air inlet mount includes an intake air tuned silencer to remove audio frequency intake noises.

11 Claims, 5 Drawing Figures

FIG. 1.
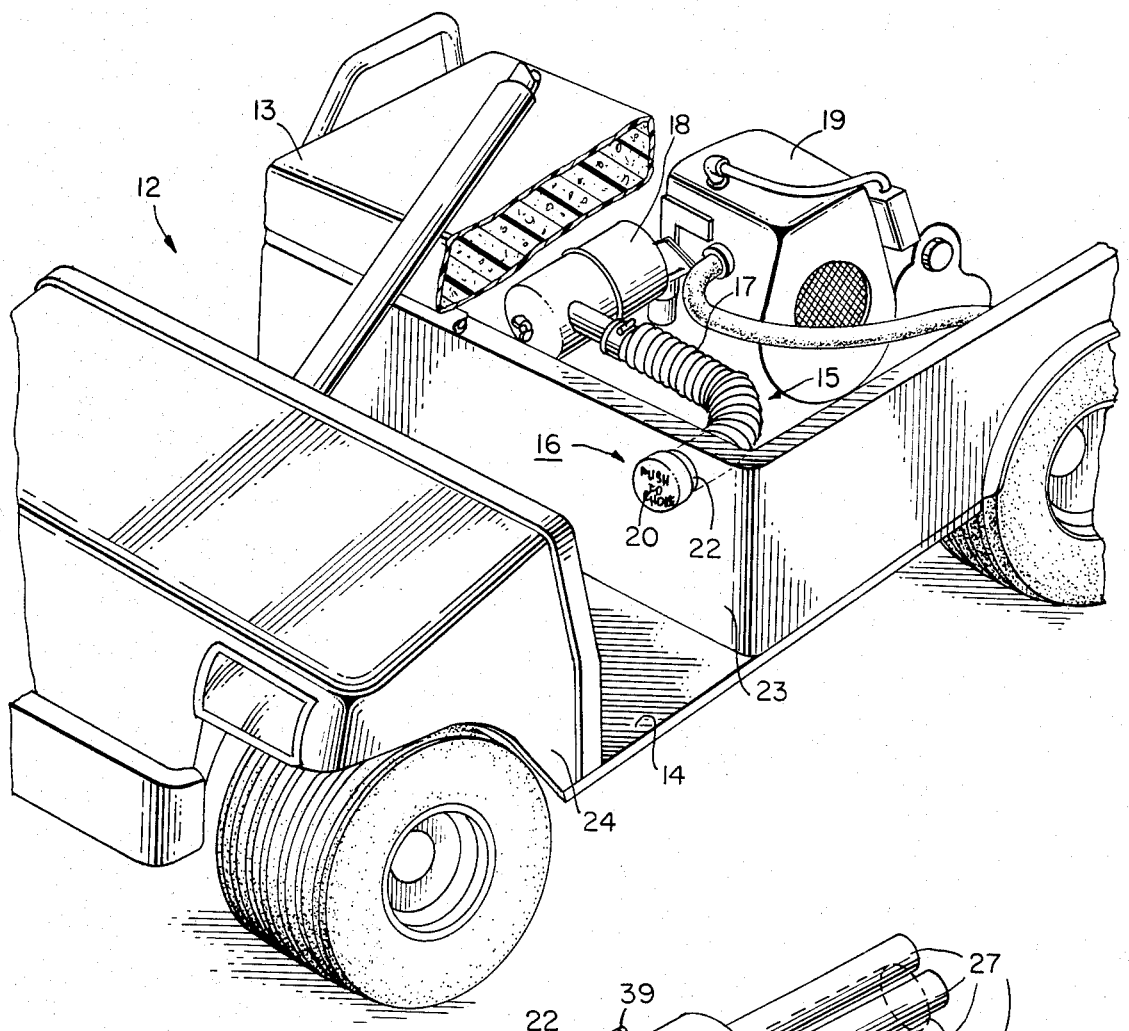
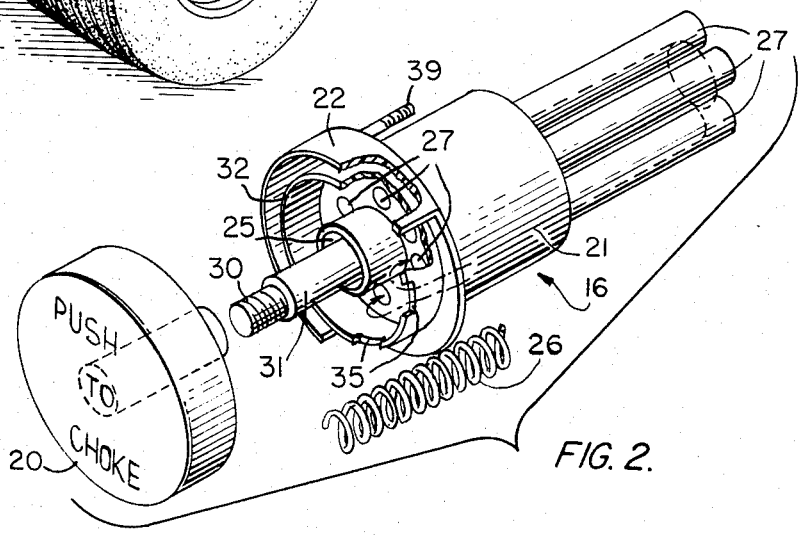
FIG. 2.

CHOKE ASSEMBLY FOR GOLF CART

TECHNICAL FIELD

This invention relates to choking an internal combustion engine and more particularly it relates to a novel choke, carburetor and air intake system which eliminates the need for a choke cable and a butterfly valve to provide reliable and efficient engine performance by means of cleaner air and uncritical choking conditions in golf carts, and the like.

BACKGROUND OF THE INVENTION

Gasoline powered golf carts are well known. Presently they use a manual choke system that includes a choke cable and a butterfly valve located in the carburetor. Mechanical problems associated with the butterfly valves and choke cables include inoperative valves and broken or binding cables. Also, this type of choke system requires critical adjustment to engine operation and the cables require custom design for different installations. With such choke cables it is easy to forget that the engine is being choked and thus engine performance is impaired when the choke is not timely released by manual cutoff. Such problems result in expensive installation with high maintenance and operating costs in golf carts that are very economically sensitive to both initial and maintenance costs. The initial cost of the choke cable and the carburetor with butterfly assembly is high, particularly when the initial tuning of idling valves, etc. to each engine performance is required.

Generally air for combustion is drawn directly into an air filter at the engine location. The air surrounding the engine of the golf cart that is drawn into the air filter contains considerable dirt generated by the wheels over dirt tracks and other grime which decreases the life of the engine and the air filter, and further increases corresponding operation and maintenance costs. When the air filter becomes dirty, then not only is more fuel required and the engine does not operate properly because of partial choking, but dirt can get into the engine to decrease engine life.

Further the choke system when the air flow path is throttled down can generate significant intake noise objectionable to the passengers.

It is therefore an object of this invention to provide an air inlet assembly for golf carts with internal combustion engines which uses a simpler carburetor and eliminates problems in the choking mechanism.

It is a further object of this invention to provide an air inlet assembly that is less critical to adjustment and installation procedures and which remains more maintenance free.

It is yet another object of this invention to minimize noise in the air intake and choking system.

It is a further object of this invention to provide cleaner air for combustion to increase the life of the air filter and the engine and to improve engine performance.

It is still another object of this invention to provide a reliable, efficient low cost engine assembly for golf carts that is easy to install and maintain.

DISCLOSURE OF THE INVENTION

A gasoline powered golf cart with a rear mounted engine in an engine compartment underneath and behind the passenger's seat is provided with a novel choke, carburetor and air intake system. The air intake is removed from the engine compartment, which is dirty and dusty for golf cart use, and positioned in the driver's compartment sheltered from the road and engine environment to reduce the dust and other foreign matter entering the air intake.

For choking, this air intake location permits the driver to manipulate or throttle the air flow into the air intake and thus the carburetor manually to simplify the carburetor permitting removal of the butterfly choke valve and all associated adjusting valves and also eliminating the mechanical choke cable assembly conventionally required. Thus a single flexible tube from an air filter mounted on the carburetor in the engine compartment to a manually controllable air intake vent located on the engine wall of the driver's compartment to admit clean air permits universal and uncritical installation of the engine and carburetor. The cleaner air and uncritical choking conditions permits better engine performance at lower installation cost and further significantly reduces maintenance costs of the air filter, the carburetor and the engine. The air intake is biased open by a spring overcame manually when choking so that the choke cannot be left in a choking position.

BRIEF DESCRIPTION OF THE DRAWINGS

In the drawings, like reference characters throughout the respective views refer to similar features;

FIG. 1 is a perspective partially cut-away view of a golf cart embodying the invention;

FIG. 2 is an exploded perspective view of the choke mechanism;

DETAILED DESCRIPTION OF THE PREFERRED EMBODIMENTS

Figure 3:
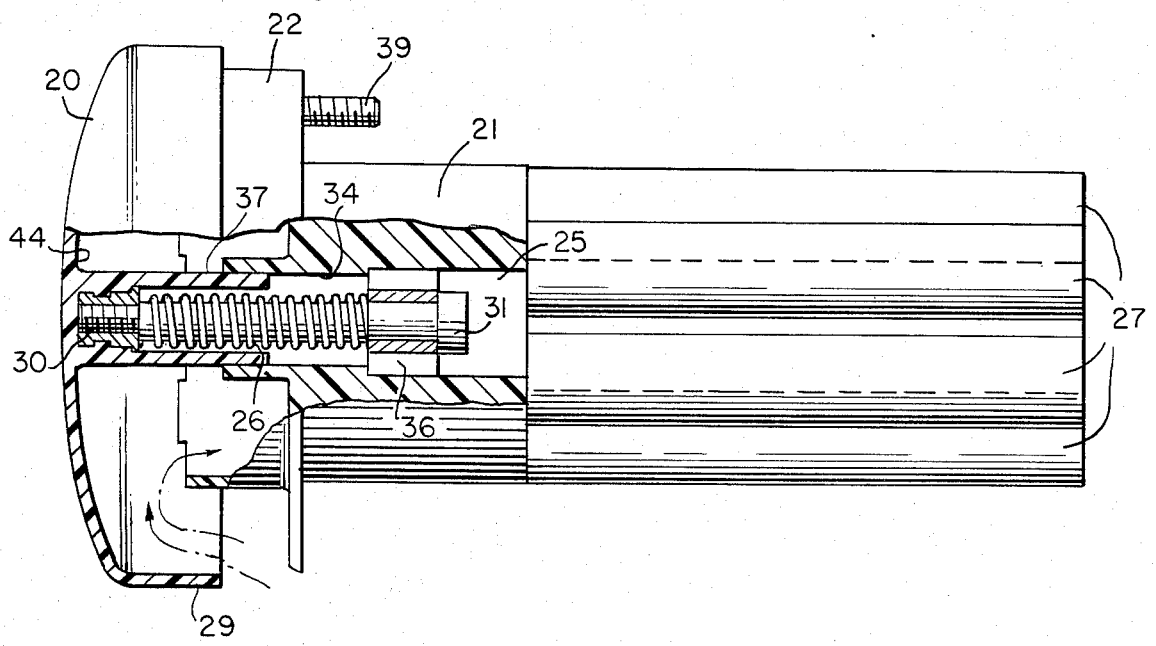
FIG. 3 is a side view of the choke mechanism partly in section and partly broken away.

As may be seen in FIG. 1, a manual choke assembly system 16 is provided with a choke mechanism 20 and air inlet tube 22 that is installed in the engine compartment wall 23 of the golf cart 24 in the passenger compartment 12 directly under the driver's seat 13 for manual access by the driver. The choke mechanism 20 not only is easy for the driver to reach and operate but also admits clean air shielded by the floor 14 from the more prominent dust raised underneath the engine compartment 15 of cart 24 because of engine and traction wheel action which might otherwise enter the air intake if located conventionally in the engine compartment. The choke mechanism 16 is connected to a flexible tubing 17 that leads to air filter 18 which is mounted on the carburetor. An inlet port, later described in more detail, located in the choke mechanism 16 residing in the passenger compartment allows cleaner combustion air to enter the engine. The choke mechanism 16 includes a biased open inlet port valve cover plate or knob 20 to be manually manipulated for choking. Thus, to start the cold golf cart engine, the choke mechanism partly closes the inlet port and reduces the amount of air reaching the carburetor.

As shown in FIGS. 2 and 3, the choke mechanism 16 has a cover cap or knob 20 and a base portion 21. The cover cap 20 is threaded at 30 to receive mounting bolt 31 held in base 21 by spider 36. The cover cap 20 has a coaxial cylindrical skirt 37 which is journalled in the cylindrical cavity 34 of base portion 21 when cover cap is manually moved against the bias of spring 26 for choking. The hollowed out cover cap 20 is thus held with skirt 29 surrounding two concentric rings 22, 32 extending from base member 21. The upper flange portion of the base member 21 extending outwardly to ring 22 has one or more bolts 39 for installation in the engine compartment wall 23 (FIG. 1) of the golf cart 24 under the driver's seat.

The air intake holes 27 can be partly closed by inwardly moving the cover cap 20 against the bias of the spring 26 toward the inner ring 32 which extends outwardly from the base member further than outer ring 22, thereby to intercept the inner cap surface 44 of push button cap 20. The notches 35 are provided to prevent overchoking by completely closing the air path to intake holes 27 which are open to transmit air to the carburetor. Preferably the cylindrical skirt 37 of choke cap 20 is journalled in the cylindrical cavity 34 of the base member 21 for guiding the reciprocal movement thereof. Also preferably, the air flow path enters the spacing under the choke cap 20 skirt 29 and takes a circuitous path over inner ring 32 to reach air entry holes 27 thereby tending to reduce any dust or foreign matter that may be carried in the entry air.

The base portion 21 of the choke mechanism 16 preferably includes intake silencing means. In this embodiment as clarified by FIG. 4, a plurality of small tubular air passages 27 are molded into base portion 21. The molded tubular passages 27 effectively comprise a tuned filter minimizing intake and choking noise at audio frequencies that a particular engine air feed system generates.

Figure 4:
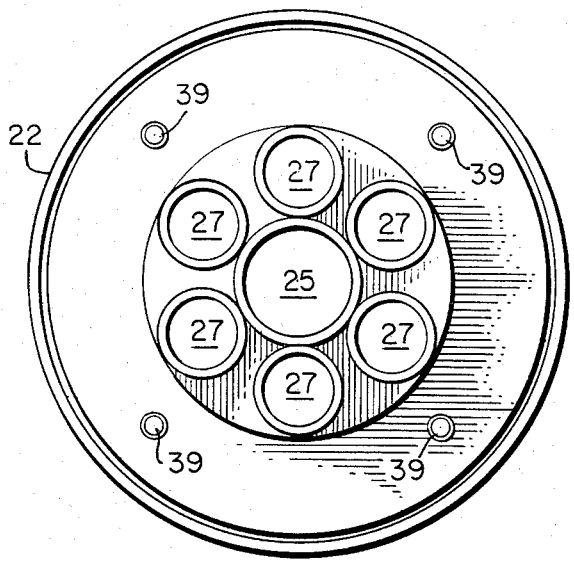
FIG. 4 is a rear end view of the choke mechanism.

The silencing means shown in FIGS. 2 and 4 basically when choked, comprises a plurality of concentric tubes 27 providing a tuned array of jet streams entering the flexible hose 17. For a given air flow and engine rating therefore the size and length of the tubes 27 is chosen to reduce noise to an acceptable level. There is a particular advantage in providing in parallel a set of reduced diameter pipes, namely that the length of the tuned filter for the audio frequencies involved may be materially shortened. Otherwise, since the air inlet 16 is located in the passenger compartment and not in the noisy engine compartment, the air flow through the inlet is not masked by engine noise and may be noisy and objectionable to the passengers. It is to be recognized that for different engines with different air intake volumes and velocities and for different size flexible tubings, etc. the length, number and diameter of the pipes 27 will change.

However, for an eight horsepower four cycle engine and a three inch (7.6 cm) diameter flexible tubing, a set of six concentrically ringed pipes 27 of one-half inch (1.3 cm) diameter and a length of five inches (14 cm) with the disclosed choking mechanism will serve to remove objectionable audio noises.

Figure 5:
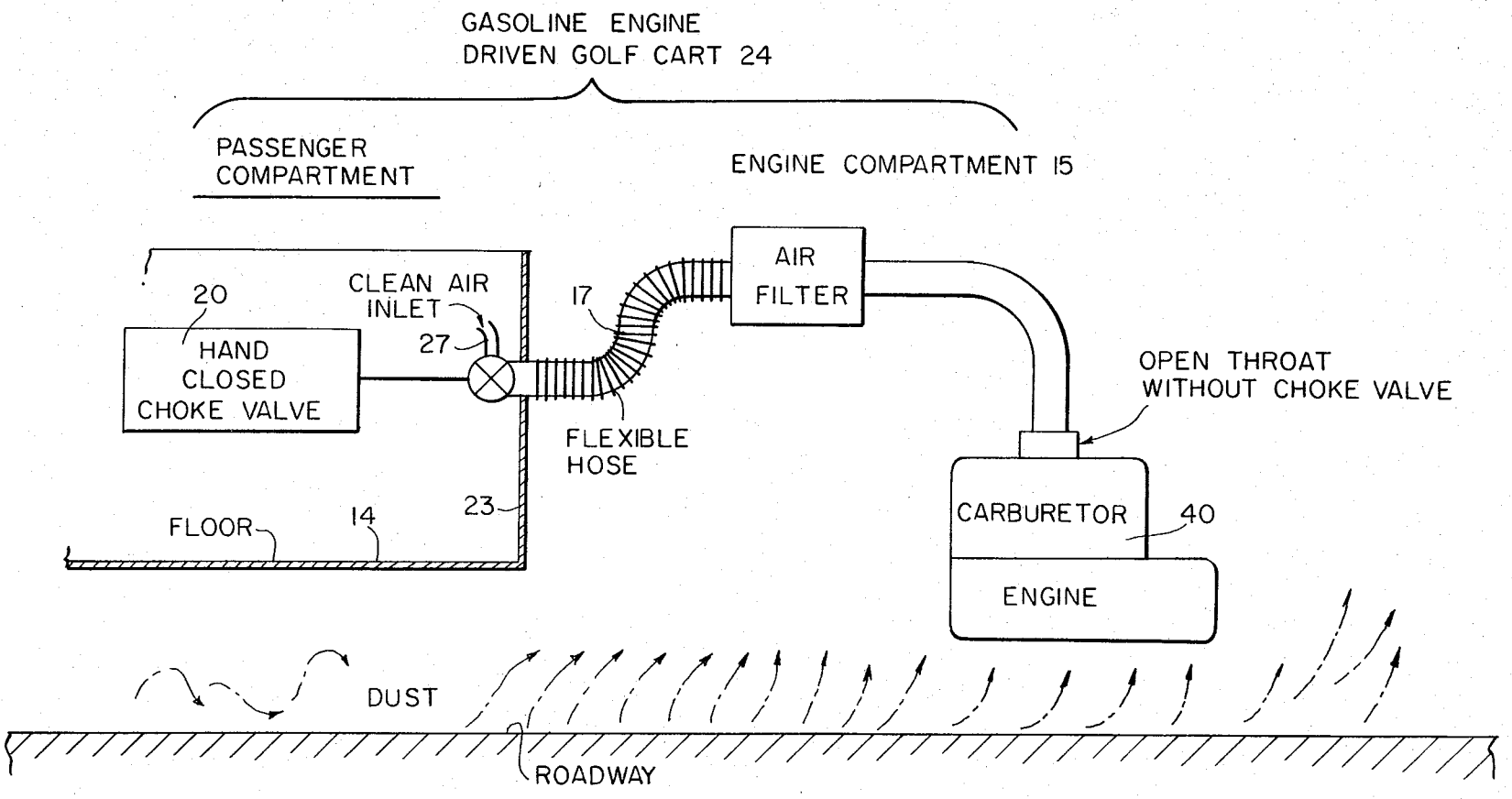
FIG. 5 is a block schematic diagram of the system afforded by the invention.

As shown in FIG. 5, the passenger compartment with its floor 14 restricting dust flow into the air inlet tubes 27 has a hand closed choke valve 20 operable to restrict air flow into the flexible hose 17 leading into the engine compartment 15. Thus a simplified open throat carburetor 40 may be employed without a complex critical butterfly choke valve with associated adjusting valves and valve operating cable assembly. In this way the engine is protected from the dust level, which is much higher in the engine compartment than in the passenger compartment location of air inlet 27 and the carburetor cost is significantly reduced. Thus, unexpectedly a lower price and more convenient initial installation feature leads to improved engine operation with less criticality, longer life and lower maintenance costs.

Having therefore advanced the state of the art as aforesaid, these novel features believed descriptive of the nature and spirit of this invention are defined with particularity in the claims.

I claim:

1. An air inlet assembly for the carburetor for an internal combustion engine of a golf cart or the like, which increases engine life, reduces maintenance cost and eliminates the need for a choke cable and butterfly valve comprising in combination, a passenger compartment protected from ground dust, and an engine compartment containing a carburetor, an air inlet port for air for combustion located in the passenger compartment for providing clean air to the carburetor, manual choking means in the passenger compartment for interrupting the flow of air through said inlet port, and a tube means comprising the major air supply for said engine and connecting said air inlet to said carburetor.

2. An air inlet as defined in claim 1 wherein the carburetor has an open throat without a choke butterfly valve.

3. An air inlet as defined in claim 2 wherein said air inlet includes a series of parallel tubes coupled to the air inlet comprising an audio noise filter to reduce air intake noise caused by manual choking.

4. An air inlet assembly as defined in claim 1 wherein the manual choking means is located on a wall between the passenger compartment and the engine compartment.

5. An air inlet assembly as defined in claim 1 wherein the choking means comprises an air inlet tubing cap biased open in an engine operating position and movable to partially block air entering the tubing for manual choking operation only by manually holding the cap in choked position overcoming the bias.

6. The assembly defined in claim 1 including an audio frequency filter in the air inlet tube means lowering noises caused during manual choking that could be heard by passengers in said compartment.

7. The combination defined in claim 1 including silencing means located adjacent the remote location for reducing air inflow noise caused by manual choking.

8. The combination of claim 1 wherein the engine drives a vehicle with a passenger compartment shielded from road dust, and said remote location is in said passenger compartment.

9. A passenger carrying internal combustion engine powered vehicle having separated engine and passenger compartments, a carburetor in said engine compartment with an open throat, and a choke valve positioned in a carburetor air inlet passageway for said carburetor located in said passenger compartment, said air inlet passageway comprising the major air supply for said engine.

10. The combination defined in claim 9 wherein the choke valve comprises means manually operable to restrict air flowing through said inlet passageway to said carburetor.

11. The combination defined in claim 10 including a choke cap about the air inlet passageway biased open by a spring to hold the air inlet passageway normally in an engine operating air flow condition serving as a choke only when the spring bias is manually overcome by moving the cap to restrict the air flow.

* * * * *